US008146708B2

(12) United States Patent
Maurer et al.

(10) Patent No.: US 8,146,708 B2
(45) Date of Patent: Apr. 3, 2012

(54) MUFFLER WITH INTEGRATED CATALYTIC CONVERTER AND POLYMERIC MUFFLER BODY

(75) Inventors: Karl Paul Maurer, North Branch, MN (US); Daniel P. Jones, Royal Oak, MI (US)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 13/013,017

(22) Filed: Jan. 25, 2011

(65) Prior Publication Data

US 2011/0186376 A1 Aug. 4, 2011

Related U.S. Application Data

(60) Provisional application No. 61/300,499, filed on Feb. 2, 2010.

(51) Int. Cl.
*F01N 13/16* (2010.01)

(52) U.S. Cl. ..... 181/246; 181/213; 181/240; 181/258; 60/274; 60/282; 60/320

(58) Field of Classification Search ..... 181/246, 181/213, 240, 258; 60/274, 282, 320
See application file for complete search history.

(56) References Cited

U.S. PATENT DOCUMENTS 4,027,476 A * 6/1977 Schmidt ..... 60/218
4,094,655 A 6/1978 Krieger
4,239,091 A * 12/1980 Negrao ..... 181/243
4,685,534 A * 8/1987 Burstein et al. ..... 181/251
5,052,513 A * 10/1991 Yoshikawa et al. ..... 181/246
5,302,783 A * 4/1994 Sadr et al. ..... 181/243
5,356,598 A * 10/1994 Boubehira et al. ..... 422/180
5,426,262 A 6/1995 Kitayama et al.
6,109,026 A 8/2000 Karlsson
6,341,662 B1 * 1/2002 Karlsson ..... 181/230
7,273,592 B2 9/2007 Jacob et al.
2007/0240934 A1 10/2007 Van de Flier et al.
2009/0078499 A1 * 3/2009 Sikes et al. ..... 181/256
2009/0194364 A1 8/2009 Leboeuf et al.
2010/0269344 A1 * 10/2010 Leboeuf et al. ..... 29/890.08

OTHER PUBLICATIONS

International Search Report, PCT/US2011/023302, Jan. 2, 2011 Date of Mailing Oct. 21, 2011.

* cited by examiner

*Primary Examiner* — Forrest M Phillips

(57) ABSTRACT

Disclosed is a muffler (1, 21, 41) integrated with a catalytic converter bed (9, 32, 52) including a polymeric muffler body (2, 22, 42), an inlet pipe (3, 23, 43) in flow communication with engine exhaust, said inlet pipe connected to a first body mounting adapter (5, 25, 45) so as to hold the inlet pipe a heat insulating distance from said polymeric muffler body, said inlet pipe in flow communication with an inlet of said catalytic converter bed (9, 32, 52), and a perforated exhaust pipe (4, 34, 44) in flow communication with an outlet of the catalytic converter bed, said perforated exhaust pipe mounted on a second body mounting adapter (6, 26, 56) so as to hold the perforated exhaust pipe a heat insulating distance from the polymeric muffler body; said inlet pipe and said perforated exhaust pipe holding said catalytic converter bed a heat insulating distance from the polymeric muffler body, said first body mounting adapter, polymeric muffler body, and second body mounting adapter forming a sealed internal chamber to provide an insulating and noise abatement space (8, 28, 48).

9 Claims, 3 Drawing Sheets

MUFFLER WITH INTEGRATED CATALYTIC CONVERTER AND POLYMERIC MUFFLER BODY

CROSS-REFERENCE TO RELATED APPLICATION

This application claims the benefit of priority of U.S. Provisional Application No. 61/300,499, filed on 2 Feb. 2010.

FIELD OF THE INVENTION

An exhaust muffler with integrated catalytic converter and having a polymeric muffler body is disclosed.

BACKGROUND OF INVENTION

Mufflers (also called silencers) are used as part of the exhaust systems of internal combustion and other types of engines, principally to reduce the noise exiting the engine with the exhaust gases (except perhaps in jet and rocket engines). Typical types of uses for these systems are on automobiles, trucks, snowmobiles, motorcycles, boats, scooters, railroad engines, electrical generators, golf carts, tractors and other motorized agricultural equipment, lawn mowers and other power landscaping equipment, etc. Virtually any use for an internal combustion engine usually also includes a muffler (system). Because of the high temperatures of the exhaust gases, and the corrosive nature of those gases, metals, particularly steel, have traditionally been used for mufflers. Corrosion is a problem with these metals, but that has partially been solved by using more expensive alloys such as stainless steel. Nevertheless mufflers have tended to be bulky (needed to reduce the noise sufficiently), and heavy because of the high density of metals.

There is a need to miniaturize and/or integrate components in order to reduce system cost and weight. Additionally environmental regulations with regards to exhaust gas emissions continue to strengthen, requiring some of these applications to install additional emissions control devices over what were used historically.

Although new technologies for emissions control devices, specifically catalytic converters, have emerged that operate at lower temperatures, while eliminating a vast majority of regulated exhaust gases, they still operate at elevated temperatures because of the exothermic reactions. In combining a catalytic converter with an exhaust muffler, as is sometimes done in order to save space on smaller vehicles, such as motorcycles, the additional exotherm of the catalytic converter has to be considered in the design. This can result in additional space and heat shielding elements which increases the cost, weight and bulk of the exhaust system.

Needed are compact mufflers integrated with catalytic converter systems for all types of internal combustion engines, thereby reducing cost and weight.

US Patent Publication 2009/0194364 A1 discloses a polymer composite muffler body wherein the polymer composite body is insulated from the exhaust pipe.

U.S. Pat. No. 6,109,026 discloses a muffler with a catalytic converter.

SUMMARY OF THE INVENTION

Disclosed is a muffler (1, 21, 41) integrated with a catalytic converter bed (9, 32, 52) comprising a polymeric muffler body (2, 22, 42), an inlet pipe (3, 23, 43) in flow communication with engine exhaust, said inlet pipe connected to a first body mounting adapter (5, 25, 45) so as to hold the inlet pipe a heat insulating distance from said polymeric muffler body, said inlet pipe in flow communication with an inlet of said catalytic converter bed (9, 32, 52), and a perforated exhaust pipe (4, 34, 44) in flow communication with an outlet of the catalytic converter bed, said perforated exhaust pipe mounted on a second body mounting adapter (6, 26, 56) so as to hold the perforated exhaust pipe a heat insulating distance from the polymeric muffler body; said inlet pipe and said perforated exhaust pipe holding said catalytic converter bed a heat insulating distance from the polymeric muffler body, said first body mounting adapter, polymeric muffler body, and second body mounting adapter forming a sealed internal chamber to provide an insulating and noise abatement space (8, 28, 48).

DETAILS OF THE INVENTION

Figure 1:
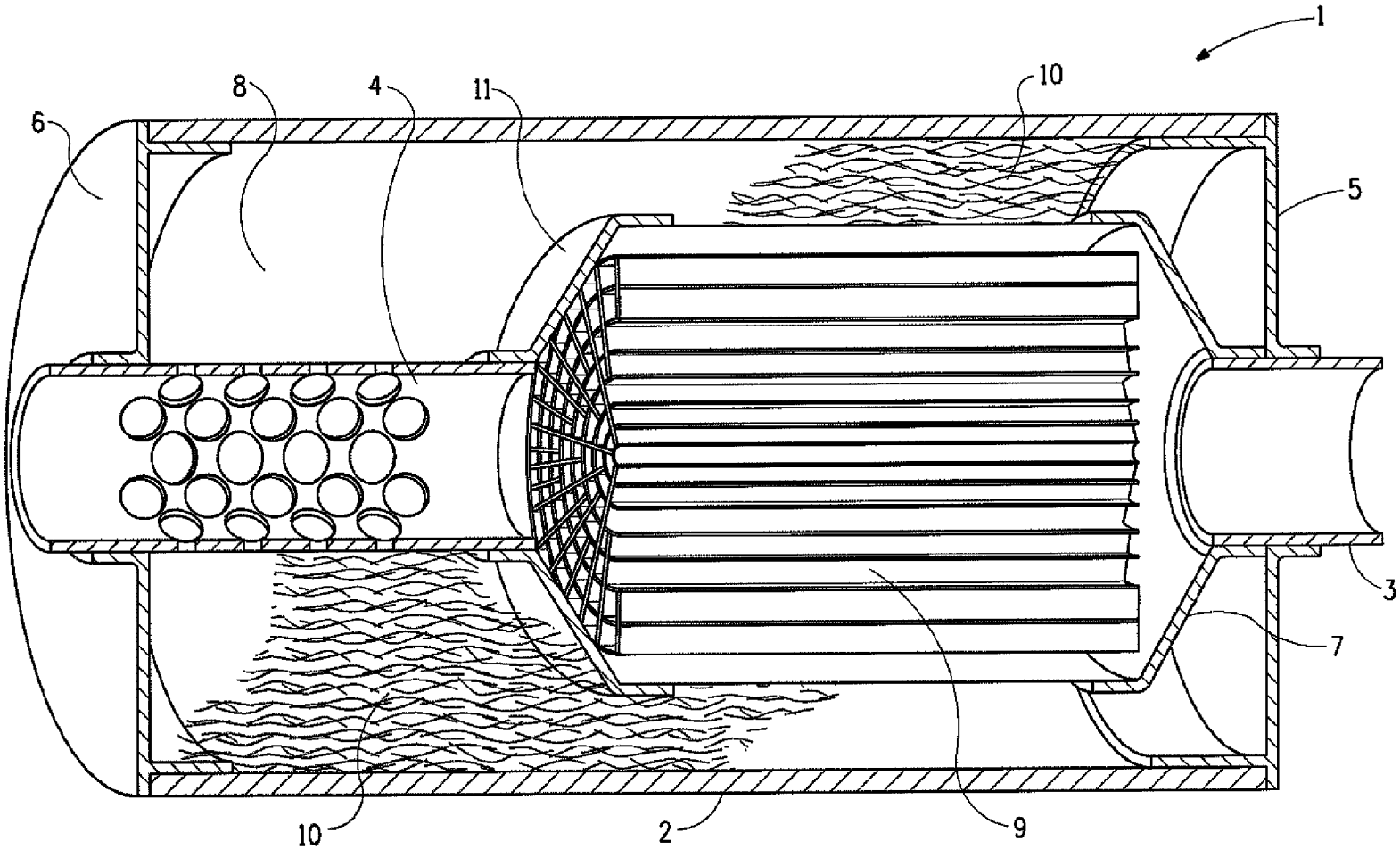
FIG. 1 shows a cutaway view of one embodiment of a muffler with integrated catalytic converter.

FIG. 1 illustrates one embodiment of an exhaust muffler (1) with integrated catalytic converter (9), showing a partial cutaway view through the polymeric muffler body (2). The inlet pipe (3) communicating to engine exhaust, is connected to a first body mounting adapter (5), so as to hold the inlet pipe (3) a heat insulating distance from the polymeric muffler body (2). The inlet pipe (3) is connected to an inlet cap (7) of a catalytic converter catalytic bed (9) providing flow communication of the inlet pipe (3) with the catalytic bed. An outlet cap (11) of the catalytic bed (9) is connected to a perforated exhaust pipe (4) to provide flow communication between the catalytic bed and perforated exhaust pipe. The perforated exhaust pipe (4) is also connected to a second body mounting adapter (6), so as to hold the perforated exhaust pipe (4) a heat insulating distance from the polymeric muffler body (2). The catalytic converter catalytic bed (9) is thus suspended a heat insulating distance from the polymeric body (2). The first body mounting adapter (5), polymeric muffler body (2), and second body mounting adapter (6) forms a sealed internal chamber to provide an insulating and noise abatement space (8). The insulating and noise abatement space may be occupied with an insulating and/or noise abatement material (10), for instance, glass fiber roving.

Figure 2:
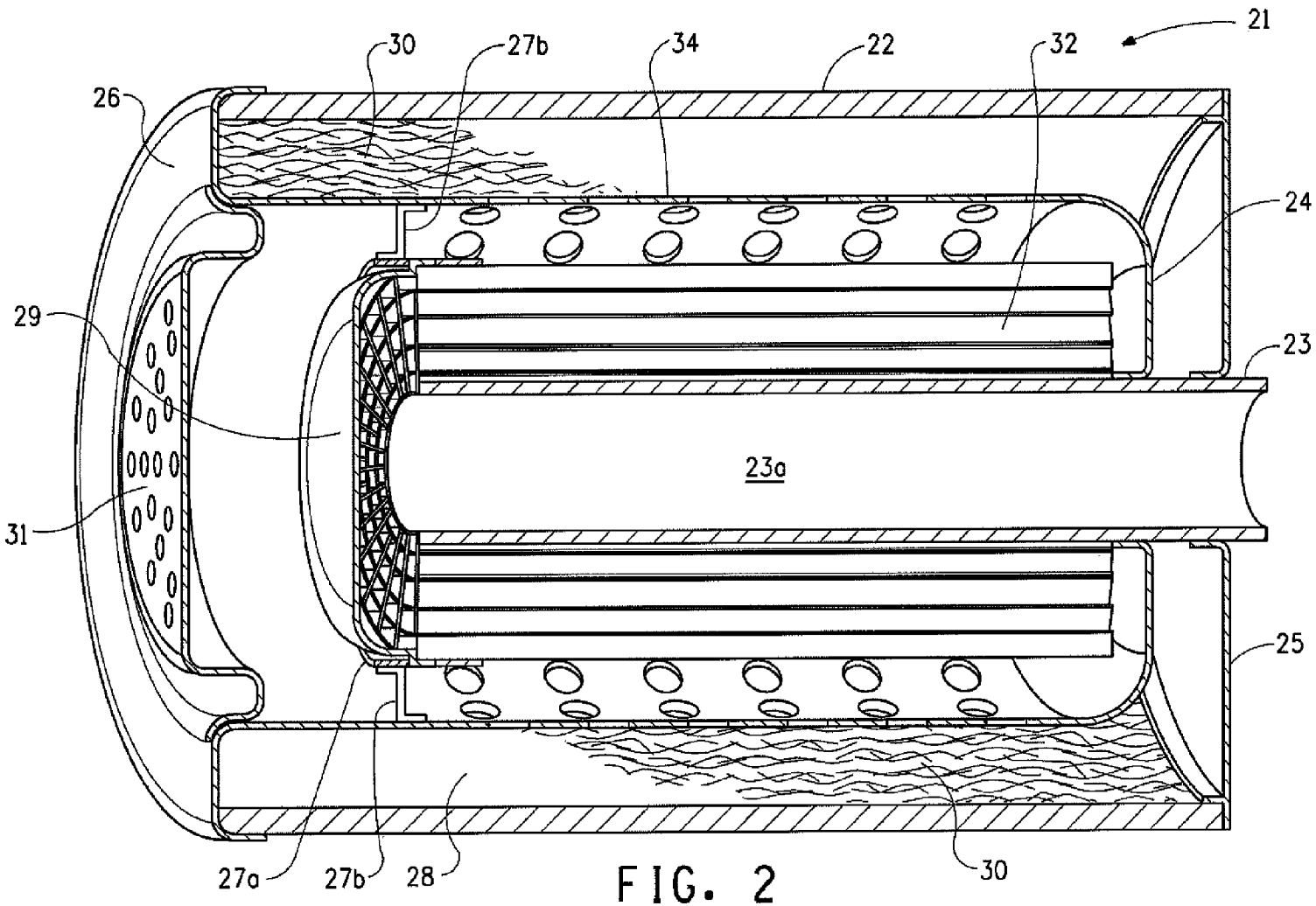
FIG. 2 shows a cutaway view of another embodiment of a muffler with integrated catalytic converter.

FIG. 2 illustrates another embodiment of an exhaust muffler (21) with integrated catalytic converter, showing a partial cutaway view through the polymeric muffler body (22). An inlet pipe (23) communicating to engine exhaust, runs through, and is connected to, a first body mounting adapter (25), so as to provide an interior pipe portion (23*a*), and so as to hold the inlet pipe (23) a heat insulating distance from the polymeric muffler body (22). The end of the interior pipe portion opposite the first body mounting adapter (25) is open. A catalytic bed (32) is mounted on an outer surface of the interior pipe portion (23*a*). A flow deflector (29) deflects gas flow from the interior pipe portion (23*a*) into the catalytic bed (32) to provide flow communication between the two. A flow deflector (24) deflects the gas flow from the outlet of the catalytic bed (32) to a perforated exhaust pipe (34) encompassing the outer surface of the catalytic bed. The perforated exhaust pipe (34) is connected to a second body mounting adapter (26), so as to hold the perforated exhaust pipe (34) a heat insulating distance from the polymeric muffler body (22). The perforated exhaust pipe (34) directs the gas flow across the outer surface of the catalytic bed providing cooling of the catalytic bed. The catalytic bed (32) and perforated exhaust pipe (34) are thus suspended a heat insulating distance from the polymeric body (22). The first body mounting adapter (25), polymeric muffler body (22), and second body mounting adapter (26) forms a sealed internal chamber to provide an insulating and noise abatement space (28). The insulating and noise abatement space may be occupied with an insulating and/or noise abatement material (30), for instance, glass fiber roving. A diffuser cap (31) may be placed over the outlet of the perforated exhaust pipe (34) to act as a spark arresting device. One or more optional support brace(s) (27*a*) and spokes (27*b*) may be present connecting the outer surface of the catalytic bed (32) to the perforated exhaust pipe (34) to provide additional structural support.

Figure 3:
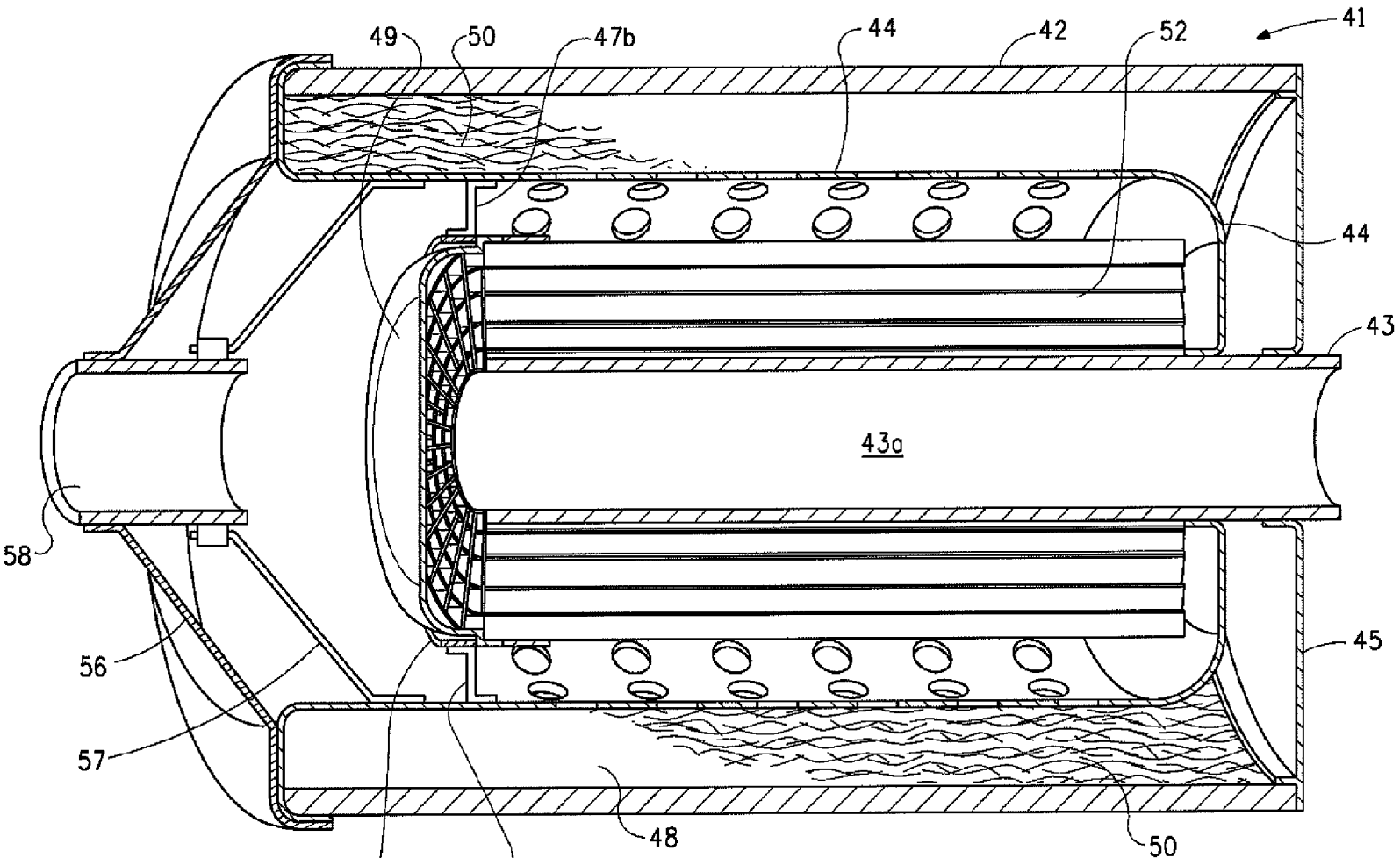
FIG. 3 shows a cutaway view of another embodiment of a muffler with integrated catalytic converter.

FIG. 3 illustrates another embodiment for the exhaust muffler (41) with integrated catalytic converter, showing a partial cutaway view through the polymeric muffler body (42). An inlet pipe (43) communicating to engine exhaust, runs through, and is connected to, a first body mounting adapter (45), so as to provide an interior pipe portion (43*a*), and so as to hold the inlet pipe (43) a heat insulating distance from the polymeric muffler body (42). The end of the interior pipe portion opposite the first body mounting adapter (45) is open. A catalytic bed (52) is mounted on an outer surface of the interior pipe portion (43*a*). A flow deflector (49) deflects gas flow from the interior pipe portion (43*a*) into the catalytic bed (52) to provide flow communication between the two. A flow deflector (44) deflects the gas flow from the outlet of the catalytic bed (52) to a perforated exhaust pipe (44) encompassing the outer surface of the catalytic bed. The perforated exhaust pipe (44) is connected to an outlet cap (57), which is connected to an outlet pipe (58). The outlet pipe (58) is connected to the second body mounting adapter (56) so as to hold the outlet pipe (58), outlet cap (57), and perforated exhaust pipe (44) a heat insulating distance from the polymeric muffler body (42). The perforated exhaust pipe (44) directs the gas flow across the outer surface of the catalytic bed providing cooling of the catalytic bed. The catalytic bed (52) and perforated exhaust pipe (44) are thus suspended a heat insulating distance from the polymeric body (42). The first body mounting adapter (45), polymeric muffler body (42), and second body mounting adapter (56) forms a sealed internal chamber to provide an insulating and noise abatement space (48). The insulating and noise abatement space may be occupied with an insulating and/or noise abatement material (50), for instance, glass fiber roving. One or more optional support brace(s) (47*a*) and spokes (47*b*) may be present connecting the outer surface of the catalytic bed (52) to the perforated exhaust pipe (44) to provide additional structural support.

By a "first body mounting adapter" is meant an adapter which holds the muffler body in position relative to the exhaust pipe, and is on the end of the muffler closest to the engine.

By a "second body mounting adapter" is meant an adapter which holds the muffler body in position relative to the perforated exhaust pipe, and is on the end of the muffler furthest away from the engine.

By "connected to" in regards to the polymeric muffler body to the first and second body mounting adapters and/or the adapters to the exhaust pipe, means fixedly attached. By "fixedly" means that in normal operation the item will not move in relationship to the item to which it is attached, but may be removable, for example, for repair or replacement.

By "a sealed internal chamber" means that the interface between the polymeric muffler body and the first body mounting adapter (5) and the polymeric muffler body second body mounting adapter (6) forms a gas-tight seal forming an internal chamber.

By a "polymeric muffler body" is meant a muffler having a body (casing) made of a polymeric material, which may be any kind of polymer, including a thermoplastic, thermoset, or an infusible polymer. An infusible polymer is not crosslinked but does not become liquid before it reaches its decomposition temperature.

By "polymeric" is meant a composition comprising a polymer and optionally containing any other materials usually found in such compositions such as fillers, reinforcing agents, stabilizers, pigments, antioxidants, and lubricants. It includes both thermoset and thermoplastic polymeric materials.

The "heat insulating distance" refers to distances between the inlet pipe, perforated exhaust pipe and catalytic bed outer surface, respectively, and the polymeric muffler body. These distances determine in part the size of the insulating and noise abatement space (8). The larger the distance between the outer surface of the exhaust pipes and catalytic converter bed, respectively, and the polymeric muffler body, for a given set of conditions, (for instance, exhaust temperature and flow), the lower the temperature to which the polymeric muffler body will be exposed. The necessary length of these distances, to achieve a certain maximum exposure for the polymeric muffler body near the first and/or second body mounting adapters or near the catalytic converter bed surface can be readily obtained by calculation (see below) using flow finite element analysis.

The heat insulating distances should be sufficient to avoid significant thermal damage to the polymeric muffler body in use. By "significant thermal damage" is meant that the polymeric muffler body will not suffer damage due to high temperatures that would render it unfit for normal use. The minimum period of time this damage would not be suffered would be determined by the equipment manufacturers specifications, but typically would be more than about 1000 hours, more preferably more than about 2000 hours, especially preferably more than about 3000 hours, and very preferably more than about 5000 hours of "normal" operation.

As noted above there should be sufficient distance between the inlet pipe and polymeric muffler body, the perforated exhaust pipe and polymeric muffler body, and the outer surface of the catalytic converter bed and polymeric muffler body, so that the polymeric muffler body is not overheated. The distance needed can be determined by trial and error. It can also be modeled using computer programs designed to calculate heat flows. A typical computer program for this purpose is Ansys® CFX, release 11 (obtained from Ansys Inc., Canonsburg, Pa. 15317, USA). Using such a modeling program the needed distance between the exhaust pipe and polymeric muffler body can be computed for any given set of conditions and polymer properties. In some instances the critical hot spot for the polymeric muffler body may be the first and/or second mounting adapter(s) at the point where it is contacting or near to contacting the polymeric muffler body. In that instance the distance between the exhaust pipe and point of contact with the polymeric muffler body of the adapter, and thermal conduction of the adapter itself, may be the critical factors.

The polymer of the polymeric muffler body should be temperature resistant enough to withstand temperatures that it may be heated to. Useful materials for these polymeric muffler include thermoplastics selected from the group consisting of semi-crystalline polyamides, thermotropic liquid crystalline polymers, polyesters, polyacetals, and thermosetting resins selected from the group consisting of epoxy, melamine and phenolic resins, and infusible polymers selected from the group consisting of polyimides, poly(p-phenylenes), and polymers comprising greater than 50% repeat units the formula

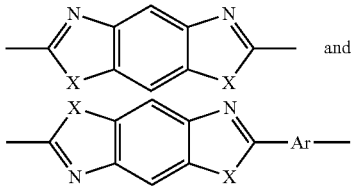

and wherein X is NH, N-Phenyl, O (oxygen) or S (sulfur), and Ar is p-phenylene, 4,4'-biphenylene or 1,4-naphthylylene. The polymeric muffler body must be capable of withstanding higher temperatures to which it may be exposed, for example by direct contact with exhaust gases and/or being heated by thermal conduction.

Thermoplastics are preferred types of polymers. Preferred thermoplastics are polyamides, especially partially aromatic polyamides. By partially aromatic polyamides is meant that some, but not all, of the repeat unit in the polyimide contain aromatic rings. Useful partially aromatic polyamides include copolyamides of 1,6-hexanediamine, terephthalic and/or isophthalic acids, and optionally adipic acid, and polyamides derived in whole or part from one or more of the following monomers, $H_2N(CH_2)_mNH_2$ wherein m is 4 to 14, $HO_2C(CH_2)_yCO_2H$ wherein y is two to 14, 2-methyl-1,5-pentanendiamine, isophthalic acid, terephthalic acid, 1,3-diaminobenzene, 1,4-diaminobenzene, and 4,4'-bibenzoic acid.

Preferred polyamides for the polymeric muffler body are Group (I) Polyamides having a melting point of at least 260° C., comprising (a) greater than 95 mole percent semiaromatic repeat units derived from monomers selected from one or more of the group consisting of:
  i) aromatic dicarboxylic acids having 8 to 20 carbon atoms and aliphatic diamines having 4 to 20 carbon atoms; and
(b) less than 5 mole percent aliphatic repeat units derived from monomers selected from one or more of the group consisting of:
  ii) an aliphatic dicarboxylic acid having 6 to 20 carbon atoms and said aliphatic diamine having 4 to 20 carbon atoms; and
  iii) a lactam and/or aminocarboxylic acid having 4 to 20 carbon atoms.

Preferred Group (I) Polyamides are selected from the group consisting of poly(tetramethylene terephthalamide/2-methylpentamethylene terephthalamide) PA4T/DT, poly(tetramethylene terephthalamide/hexamethylene terephthalamide) PA4T/6T, poly(tetramethylene terephthalamide/decamethylene terephthalamide) PA4T/10T, poly (tetramethylene terephthalamide/dodecamethylene terephthalamide) PA4T/12T, poly(tetramethylene terephthalamide/2-methylpentamethylene terephthalamide/hexamethylene terephthalamide) (PA4T/DT/6T), poly(tetramethylene terephthalamide/hexamethylene terephthalamide/2-methylpentamethylene terephthalamide) (PA4T/6T/DT), poly(hexamethylene terephthalamide/2-methylpentamethylene terephthalamide) (PA6T/DT), poly(hexamethylene hexanediamide/hexamethylene isophthalamide) (PA 6T/61), poly(hexamethylene terephthalamide/decamethylene terephthalamide) PA6T/10T, poly(hexamethylene terephthalamide/dodecamethylene terephthalamide) (PA6T/12T), poly(hexamethylene terephthalamide/2-methylpentamethylene terephthalamide/poly(decamethylene terephthalamide) (PA6T/DT/10T), poly(hexamethylene terephthalamide/decamethylene terephthalamide/dodecamethylene terephthalamide) (PA6T/10T/12T), poly(decamethylene terephthalamide) (PA10T), poly(decamethylene terephthalamide/tetramethylene terephthalamide) (PA10T/4T), poly (decamethylene terephthalamide/2-methylpentamethylene terephthalamide) (PA10T/DT), poly(decamethylene terephthalamide/dodecamethylene terephthalamide) (PA10T/12T), poly(decamethylene terephthalamide/2-methylpentamethylene terephthalamide/(decamethylene terephthalamide) (PA10T/DT/12T), poly(dodecamethylene terephthalamide) (PA12T), poly(dodecamethylene terephthalamide)/tetramethylene terephthalamide) (PA12T/4T), poly(dodecamethylene terephthalamide)/hexamethylene terephthalamide) PA12T/6T, poly(dodecamethylene terephthalamide)/decamethylene terephthalamide) (PA12T/10T), and poly(dodecamethylene terephthalamide)/2-methylpentamethylene terephthalamide) (PA12T/DT); and a most preferred Group (I) Polyamide is PA6T/DT.

The polyamide resin used in the present invention has a melting point. Herein melting points are as determined with differential scanning calorimetry (DSC) at a scan rate of 10° C./min in the first heating scan, wherein the melting point is taken at the maximum of the endothermic peak.

The thermoplastic composition may include 0 to 60 weight percent of one or more reinforcement agents. In one embodiment the thermoplastic composition includes about 10 to 60 weight percent of one or more reinforcement agents.

In another embodiment the composition includes less than 10 weight percent of one or more reinforcement agents, and preferably less than 1 weight %.

The reinforcement agent may be any filler, but is preferably selected from the group consisting calcium carbonate, glass fibers with circular and noncircular cross-section, glass flakes, glass beads, carbon fibers, talc, mica, wollastonite, calcined clay, kaolin, diatomite, magnesium sulfate, magnesium silicate, barium sulfate, titanium dioxide, sodium aluminum carbonate, barium ferrite, potassium titanate and mixtures thereof.

The polymeric muffler body is preferably a single part but may be more than one part. If there is more than one part they are usually split longitudinally. For instance the body may be extruded in two halves which are joined, perhaps by one or more separate exterior clamps, or the two parts may "snap fit" together, and/or be joined by an adhesive, or be welded together, for instance by laser welding or vibration welding. A sealant may be used to ensure no gas leakage from the joint(s) formed.

The thickness of the polymeric muffler body may vary across the polymeric muffler body cross section. For example in a vehicle it may be an advantage for the bottom surface of the polymeric muffler body to be thicker than the top surface.

The muffler integrated with a catalytic converter bed may have a polymeric muffler body of uniform cross section In the various embodiments the inlet pipes (3, 23, 43) inlet cap (7), outlet cap (11) flow deflectors (24, 29, 44, 49), perforated exhaust pipes (4, 34, 44), optional support braces (27*a*, 47*a*) spokes (27*b*, 47*b*) and catalytic converter bed (9, 32, 52) should be made of a material which resists high temperatures, such as metal, and preferably the metal is stainless steel. All of these parts can be joined together by furnace braising, welding or other metal joining process to provide a sub-assembly which is then wrapped with the insulating and/or noise abatement material (10, 30, 50). The wrapped sub-assembly is then encased in the polymeric muffler body and fitted with the first and second body mounting adapters (5, 25, 45) and (6, 26, 46)

The first and second body mounting adapters (5, 25, 45) and (6, 26, 46) hold the polymeric muffler body in position relative to the exhaust pipes and catalytic converter bed. The body mounting adapters (5) and (6) should be made of a material which resists high temperatures, such as metal or ceramic. Metal is preferred for one or both of the body mounting adapters. A body mounting adapter may be one or more pieces, for example they may slide onto the exhaust pipe, or be essentially split rings. One piece adapters are preferred. The first and second body mounting adapters may be the same or different design. The body mounting adapters may be attached to the exhaust pipe by a variety of methods, for instance (assuming they are metal) welded, clamped, force fit, bolted or screwed, etc. Since it is usually undesirable to have exhaust gas leaking from between the exhaust pipe and the adapters it may be desirable to use a high temperature mastic or similar material to seal the joint between the exhaust pipe and the adapter(s), particularly if it is not completely welded.

The adapters may hold the polymeric muffler body in place by any number of means. For instance a gasket may be used to both hold the body and seal the joint between the adapter and the body. Other mechanical means such as bolts or (sheet metal) screws may also be used. In this case a sealant may be desirable to ensure a gas tight joint.

As previously mentioned the body mounting adapters hold the polymeric muffler body in position relative to the inlet pipe (3, 23, 43) and the perforated exhaust pipe (4, 34, 44). In FIG. 1 the exhaust pipe need not go through the center (longitudinally) of the polymeric muffler body, it may be off center. The perforated exhaust pipe (4) need not run parallel to the sides of the muffler body but may be, for example, diagonal to the long axis of the muffler body. The perforated exhaust pipe (4) may curve inside the polymeric muffler body, but not be so close at any given point that it will cause the temperature of the polymeric muffler body to get too high. These "differences" in the relative positions of the polymeric muffler body and the perforated exhaust pipe (4) will be determined by the configuration of the adapter(s) and whether or not the exhaust pipe is straight or not.

Various ways to connect the first and second body mounting adapters (5, 25, 45) and (6, 26, 46) to the polymeric muffler body (2, 22, 42) are disclosed in FIGS. 2A, 2B, and 2C of US Patent Publication 2009/0194364 A1, hereby incorporated by reference.

The catalytic converter bed can be of conventional construction wherein the internal surfaces of the bed are coated with a catalyzing layer. The catalyst bed can be constructed of stainless steel, monolithic ceramic brick, or a plurality of spherical or non-spherical ceramic beads incased in a metal or ceramic housing. When exhaust gases pass over the internal surfaces the gases are cleaned when they come into contact with the internal surfaces. The converter bed often reaches temperatures exceeding 1000 degrees C. and must therefore be cooled down, for instance by means of heat dissipation. The embodiments of the muffler with integrated catalytic converter disclosed herein allow operation of the muffler without additional external heat shielding.

The catalyst bed efficiently controls emissions only when it reaches operating temperature and ignites, so that combustion of the exhaust gases can occur. This means that the initial flow of exhaust gases immediately after start-up of the engine may flow through the catalyst bed relatively untreated, because the catalyst bed is not sufficiently hot to combust the exhaust gases. For this reason, it is advantageous to insulate the catalyst bed so that it can heat up rapidly, thus attaining operating temperatures quickly and reducing the time during which the emissions control advantages of the converter are not being realized. As emissions regulations continue to drive down the permissible hydrocarbon emissions at start-up, the faster a catalytic converter can reach operating temperature, the better.

With the use of a polymeric housing and acoustic and/or thermal insulation, the amount of heat that is contained within the catalyst bed is increased versus traditional metallic designs, because the polymeric casing transfers less heat away from the catalyst bed than a metal housing, due to the lower heat transfer through polymers versus metals. This means that a polymeric housing reduces the time required to reach ignition temperature within the catalyst bed. This allows a unit with the polymeric housing according to the invention to perform more quickly on start-up.

The invention claimed is:

1. A muffler integrated with a catalytic converter bed comprising a polymeric muffler body , an inlet pipe in flow communication with engine exhaust, said inlet pipe connected to a first body mounting adapter so as to hold the inlet pipe a heat insulating distance from said polymeric muffler body, said inlet pipe in flow communication with an inlet of said catalytic converter bed, and a perforated exhaust pipe in flow communication with an outlet of the catalytic converter bed, said perforated exhaust pipe mounted on a second body mounting adapter so as to hold the perforated exhaust pipe a heat insulating distance from the polymeric muffler body; said inlet pipe and said perforated exhaust pipe holding said catalytic converter bed a heat insulating distance from the polymeric muffler body, said first body mounting adapter, polymeric muffler body, and second body mounting adapter forming a sealed internal chamber to provide an insulating and noise abatement space.

2. The muffler integrated with a catalytic converter bed of claim 1 wherein the insulating and noise abatement space is filled or partially filled with a noise abatement material.

3. The muffler integrated with a catalytic converter bed of claim 2 wherein the noise abatement material is glass fiber roving.

4. The muffler integrated with a catalytic converter bed of claim 1 wherein the body mounting adapters, perforated exhaust pipe, exhaust pipe, and catalyst bed are all joined together either by welding, furnace brazing, or other metal joining process.

5. The muffler integrated with a catalytic converter bed of claim 1 wherein the polymeric body is molded in multiple pieces that are joined together with fasteners, adhesives, or through a polymeric welding process.

6. The muffler integrated with a catalytic converter bed of claim 1 wherein the polymeric muffler body is of uniform cross section.

7. The muffler integrated with a catalytic converter bed of claim 1 wherein the polymeric body is constructed of thermoplastics selected from the group consisting of semi-crystalline polyamides, thermotropic liquid crystalline polymers, polyesters, polyacetals, and thermosetting resins selected from the group consisting of epoxy, melamine and phenolic resins, and infusible polymers selected from the group consisting of polyimides, poly(p-phenylenes), and polymers comprising greater than 50% repeat units the formula

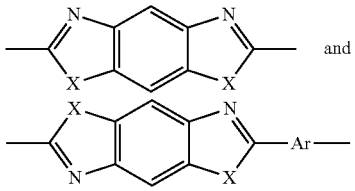

and wherein X is NH, N-Phenyl, O (oxygen) or S (sulfur), and Ar is p-phenylene, 4,4'-biphenylene or 1,4-naphthylylene.

8. The muffler integrated with a catalytic converter bed of claim 1, wherein the polymeric muffler body comprises Group (I) Polyamides having a melting point of at least 260° C., comprising (a) greater than 95 mole percent semiaromatic repeat units derived from monomers selected from one or more of the group consisting of:

i) aromatic dicarboxylic acids having 8 to 20 carbon atoms and aliphatic diamines having 4 to 20 carbon atoms; and (b) less than 5 mole percent aliphatic repeat units derived from monomers selected from one or more of the group consisting of:

ii) an aliphatic dicarboxylic acid having 6 to 20 carbon atoms and said aliphatic diamine having 4 to 20 carbon atoms; and iii) a lactam and/or aminocarboxylic acid having 4 to 20 carbon atoms.

9. The muffler integrated with a catalytic converter bed of claim 1 wherein the catalyst bed is constructed of stainless steel, monolithic ceramic brick, or a plurality of spherical or non-spherical ceramic beads in a container.

* * * * *